US007946875B2

(12) United States Patent
Li et al.

(10) Patent No.: US 7,946,875 B2
(45) Date of Patent: May 24, 2011

(54) CARD EDGE CONNECTOR WITH AN IMPROVED RETAINER

(75) Inventors: Zhuang-Xing Li, Kunshan (CN); Ze-Lin Yao, Kunshan (CN); Xue-Wu Bu, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/862,969

(22) Filed: Aug. 25, 2010

(65) Prior Publication Data

US 2011/0053400 A1 Mar. 3, 2011

(51) Int. Cl.
*H01R 13/62* (2006.01)

(52) U.S. Cl. ..... 439/327; 439/347

(58) Field of Classification Search ..... 439/59, 439/325, 327, 328, 347, 350
See application file for complete search history.

(56) References Cited

U.S. PATENT DOCUMENTS

| | | | | |
|---|---|---|---|---|
| 5,676,561 | A * | 10/1997 | Chiang | 439/328 |
| 6,210,195 | B1 * | 4/2001 | Ma | 439/327 |
| 6,375,486 | B1 | 4/2002 | Yu | |
| 6,672,888 | B1 * | 1/2004 | Ku | 439/153 |
| 6,709,283 | B2 * | 3/2004 | Lai | 439/327 |
| 6,884,100 | B1 | 4/2005 | Hsiao | |
| 6,902,419 | B2 | 6/2005 | Conway et al. | |
| 7,083,448 | B2 * | 8/2006 | Tanigawa | 439/160 |
| 7,121,862 | B2 * | 10/2006 | Tang et al. | 439/327 |

* cited by examiner

*Primary Examiner* — Thanh-Tam T Le
(74) *Attorney, Agent, or Firm* — Wei Te Chung; Andrew C. Cheng; Ming Chieh Chang

(57) ABSTRACT

A card edge connector (100) for use with an electronic card (100) includes an elongated housing (1) having a pair of opposited side walls (10), a central slot (11) between the side walls (10), and a holding portion (12) at one end thereof. The holding portion (12) defining at least one leading hole (126) extending along a length direction of the housing (1). A retainer (3) is movably retained in the holding portion (12). The retainer (3) has a body portion (31) with a positioning post (315) received in the leading hole (126), a latch projection (12) protruding inwardly from the body portion (31) for locking the electronic card (200). Wherein the positioning post (315) is movable in the leading hole (126) along the length direction so as to prevent the retainer (3) from being separated from the holding portion (12).

9 Claims, 5 Drawing Sheets

CARD EDGE CONNECTOR WITH AN IMPROVED RETAINER

BACKGROUND OF THE INVENTION

1. Field of the Invention

The present invention relates to card edge connectors, more particularly to a card edge connector with an improved retainer that cannot be pulled out of a housing thereof.

2. Description of Related Art

Card edge connectors are employed widely in computers to receive a memory card, graphic card, network interface card et al. The card edge connectors usually have an elongated housing, a plurality of contacts retained in the housing for electrically connecting a corresponding mating card, and at least a retainer at one end thereof for locking the mating card. The mating card has a projection at one side end thereof and a notch above the projection. The housing has a pair of elongated side walls and a central slot between the side walls for receiving the mating card. The side wall each defines a recess parallel with the central slot and a flute formed at an inner end of the recess. The recesses pass through an outer end of the side walls along a length direction of the housing. The retainer includes a body portion and a pair of extending arms extending inwardly from the body portion and corresponding to the recess. The body portion has a top portion, a pair of side portions extending downwardly from two sides of the top portion to form a receiving cavity therebetween. The extending arms each defines a hook at a free end thereof.

After the mating card has been inserted into the central slot, pushing the body portion to allow the extending arms to moving inwardly along the recesses respectively until the hooks locking into the flute. The projection of the mating card is receiving into the receiving cavity. The top portion of the body portion abuts downwardly against the projection of the mating card for locking mating card on the card edge connector. However, While the mating card is being ejected, pulling the retainer to move outwardly, the retainer may be pulled out of the housing by handling.

Hence, an improved card edge connector is desired to overcome the above problems.

BRIEF SUMMARY OF THE INVENTION

According to one aspect of the present invention, a card edge connector for use with an electronic card, comprises an elongated housing having a pair of opposited side walls, a central slot between the side walls, and a holding portion at one end thereof. The holding portion defining at least one leading hole extending along a length direction of the housing. A plurality of terminals retained in the housing and protruding into the central slot for mating with the electronic card. A retainer movably retained in the holding portion. The retainer has a body portion with a positioning post received in the leading hole, a latch projection protruding inwardly from the body portion for locking the electronic card. Wherein the positioning post is movable in the leading hole along the length direction so as to prevent the retainer from being separated from the holding portion.

According to another aspect of the present invention, a card edge connector for use with an electronic card, comprises an insulative housing defining an elongated central slot along a lengthwise direction. A holding portion unitarily located around one end of the housing. The holding portion defines an upper wall, a bottom wall opposited to the upper wall, a cavity formed therebetween, and two opposite leading slots recessed on the upper and bottom wall and in communication with cavity. The leading slots extends along the lengthwise direction. A retainer includes a body portion received in the cavity, a latch projection protruding outwardly of the cavity for locking with the electronic card. At least two opposite portioning posts are movably received in the leading slots along the lengthwise direction respectively.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
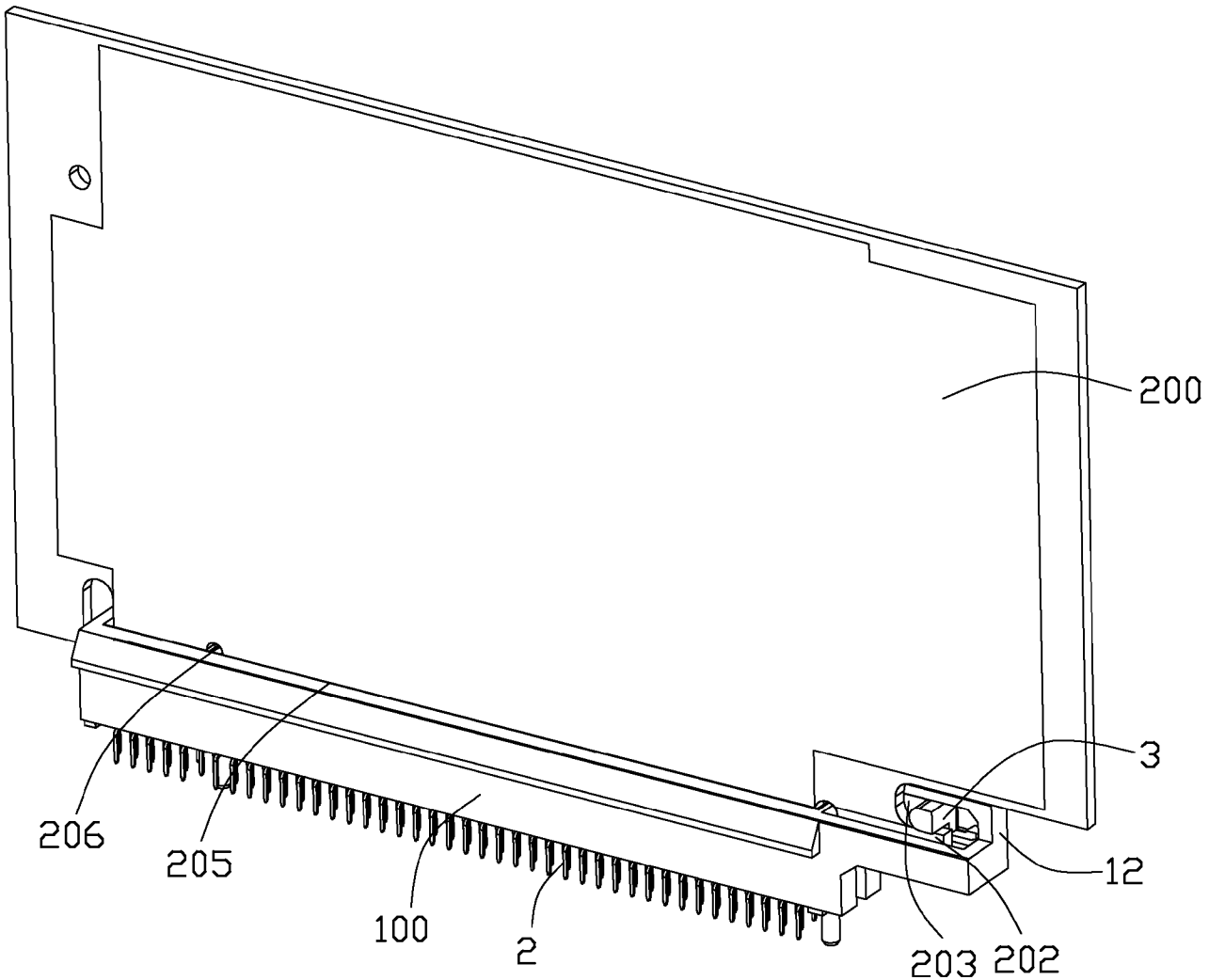
FIG. 1 is a perspective view showing an electronic card received in a card edge connector in accordance with the preferred embodiment of the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 2:
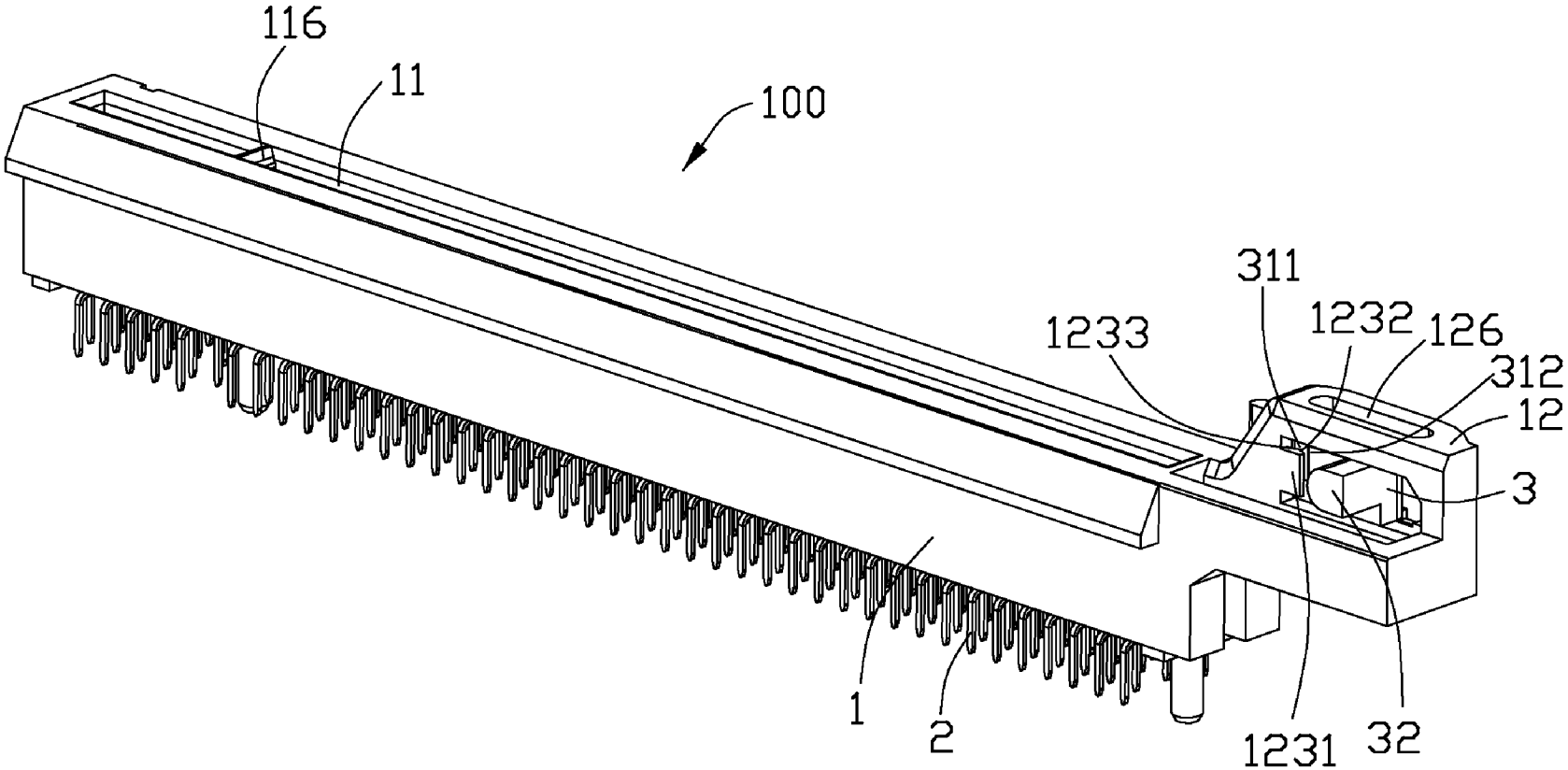
FIG. 2 is a perspective view of the card edge connector shown in FIG. 1.
Figure 3:
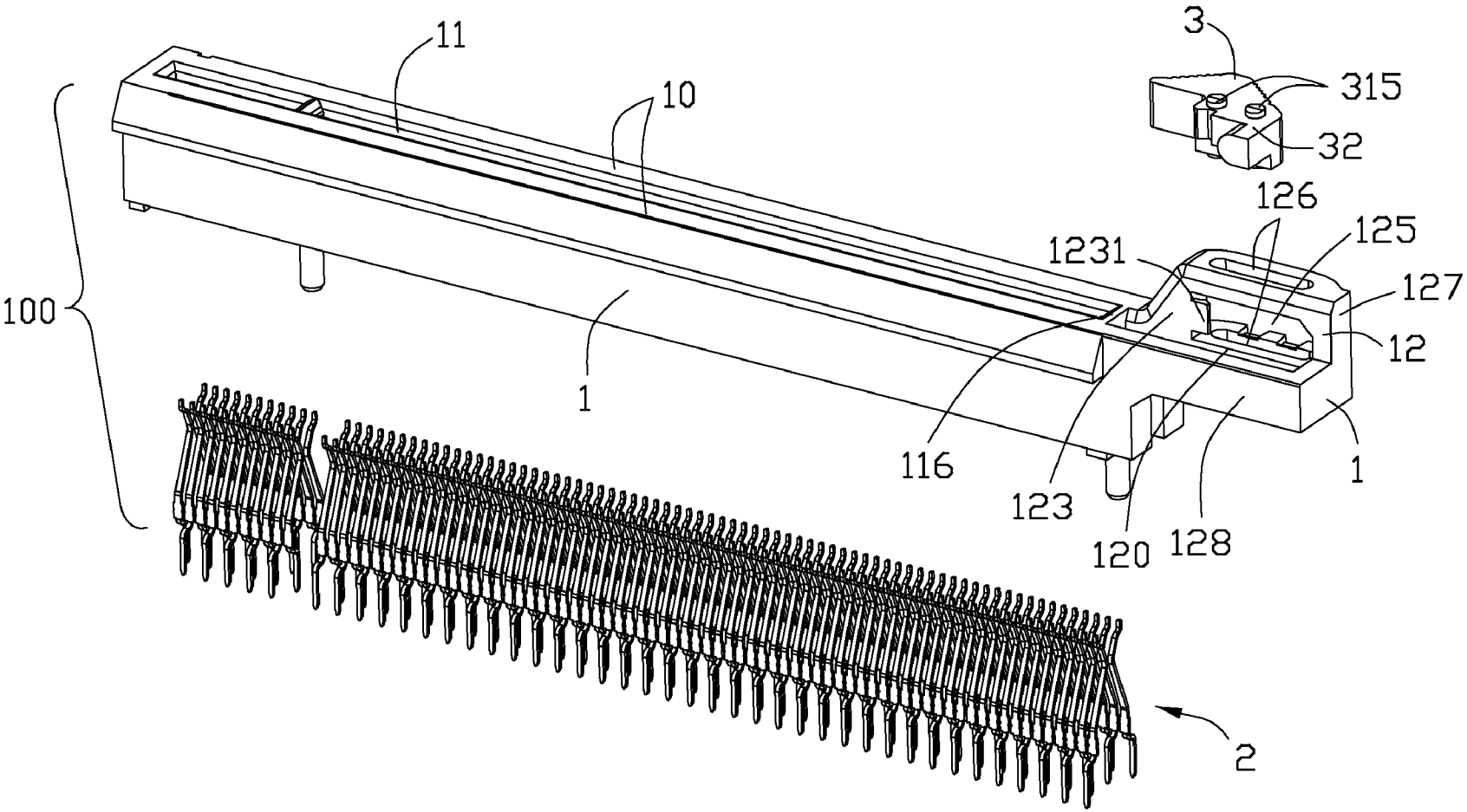
FIG. 3 is an exploded view of the card edge connector shown in FIG. 1.
Figure 4:
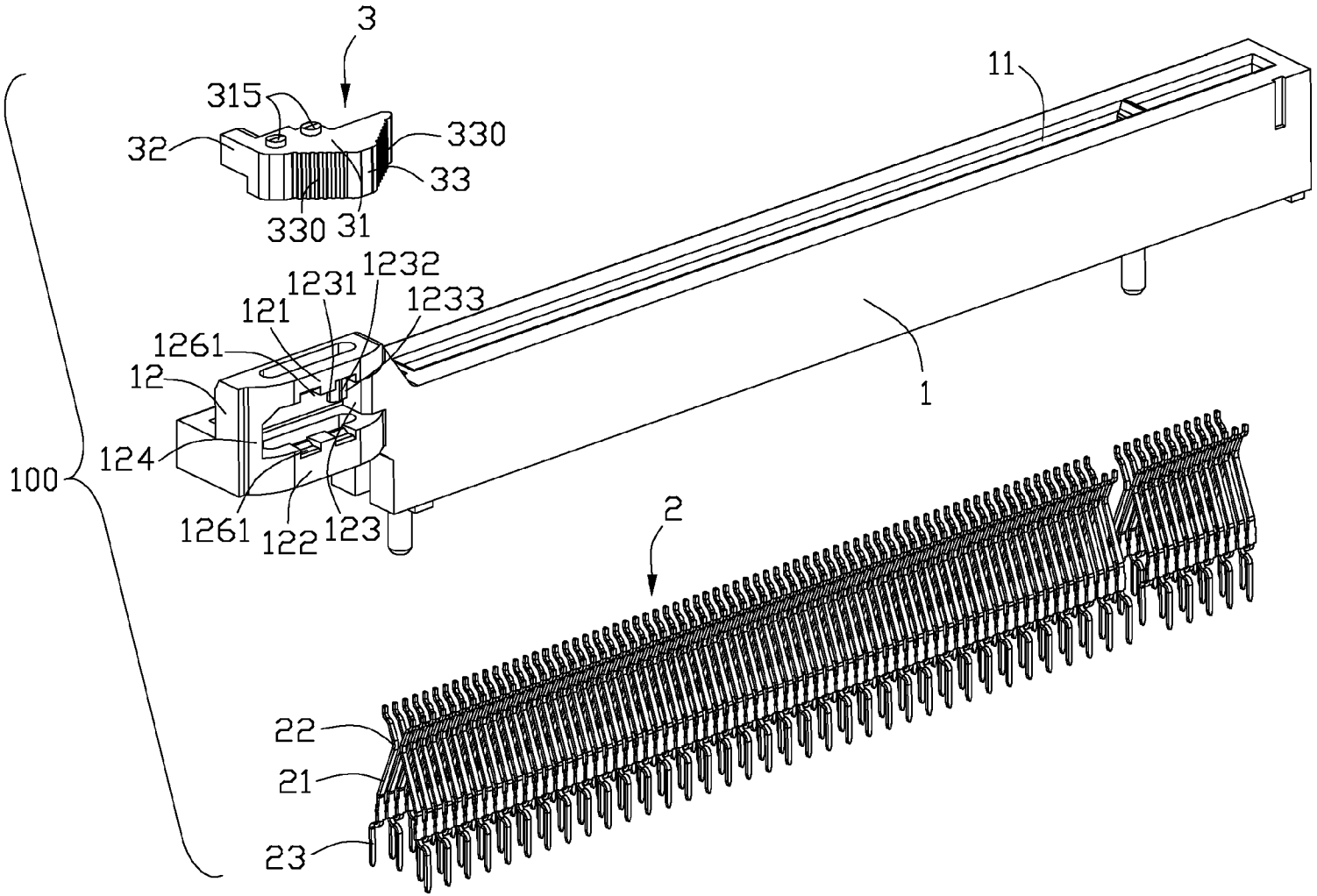
FIG. 4 is another exploded view of the card edge connector shown in FIG. 1.
Figure 5:
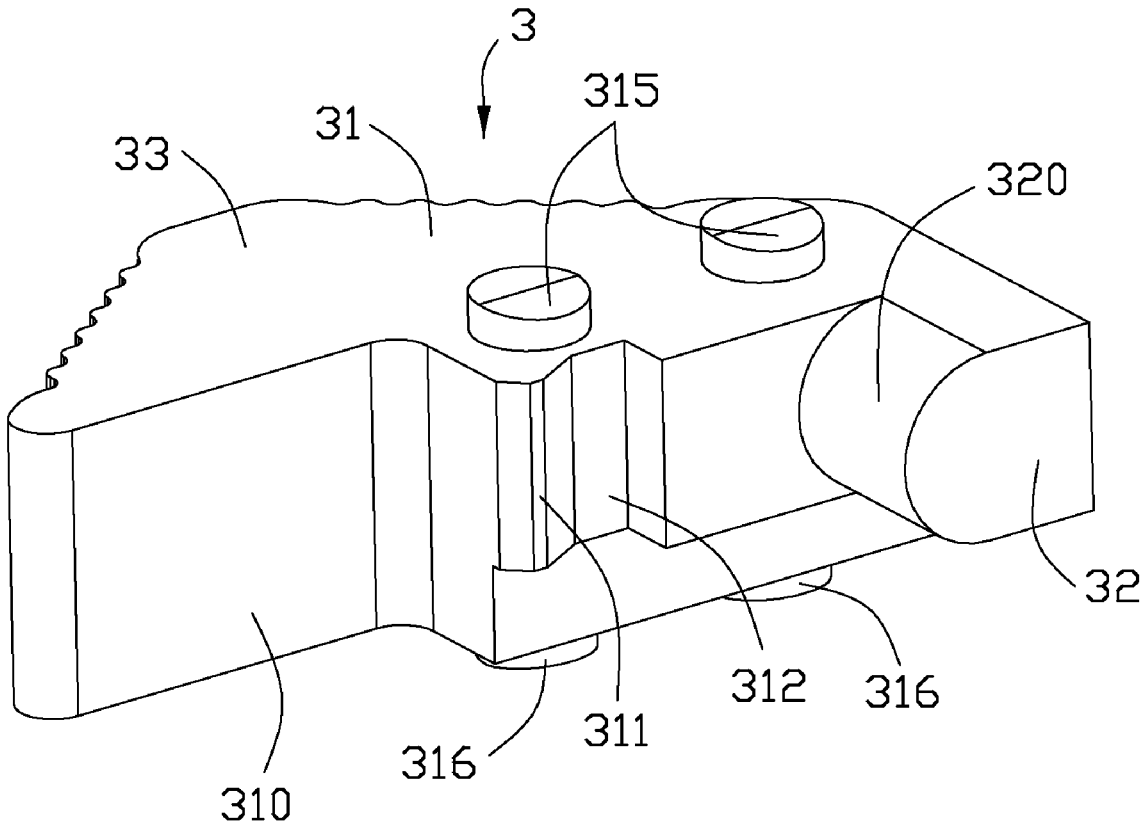
FIG. 5 is a perspective view of a retainer of the card edge connector shown in the FIG. 1.

Referring to FIGS. 1-5, a card edge connector 100 for use with an electronic card 200 in accordance with the preferred embodiment of the present invention is disclosed. The card edge connector 100 comprises an elongated housing 1, a plurality of terminals 2 retained in the housing 1, and an insulative retainer 3 movable retained on the housing 1.

The electronic card 200 has a projection 202 at one side end thereof, a cutout 203 above the projection 202, a lower mating edge 205 with a plurality of conductive pads (not shown) on opposite sides thereof. A plurality of notches 206 are defined in the mating edge 50.

The housing 1 includes a pair of elongated side walls 10, a central slot 11 between the side walls 10, and a holding portion 12 at one end of the housing 1. The central slot 11 extends along a length direction of the housing 1 for receiving the mating edge 205 of the electronic card 200. The housing 1 has a plurality of key portions 116 disposed in central slot 11 and corresponding to the notches 206 of the electronic card 200. The key portions 116 provide multiple functions such as supporting the side walls 10 as well as providing polarization for the electronic card 200. The terminals 2 are respectively retained in the side wall 10 and protruding into the central slot 11 for contacting conductive pads of the mating edge 205 of the electronic card 200.

The holding portion 12 includes a first wall 127 and a second wall 128 aligned with side walls 10 respectively along the length direction. The first and second walls 127, 128 extend outwardly from the side wall 10 along the length direction. The first wall 127 is higher than the second wall 128. The first wall 127 is aparted from the second wall 128 to form a receiving space 120 therebetween to receive the projection 202 of the electronic card 200. The receiving space 120 is aligned with the central slot 12 along the length direction. One key portion 116 is located between the receiving space 120 and the central slot 11. The receiving space 120 does not communicate with the central slot 11.

The first wall 127 defines a cavity 125 extending therethrough along a width direction perpendicular to the length direction to make the first wall 127 be divided into an upper wall 121, a bottom wall 122 opposited to the upper wall 121, a left wall 123 and a right wall 124 opposited to the left wall 123. The cavity 125 is formed among the upper wall 121, bottom wall 122, left and right walls 123, 124. The left wall 123 directly connects with the side wall 10. The right wall 124 is located at outside of the left wall 123 along the length direction of the housing 1. The upper and bottom walls 121, 122 define a pair of elliptic-shape leading holes 126 extending therethrough along a vertical direction of the housing 1 and in communication with the cavity 125. The leading holes 126 are opposited to each other along the vertical direction and extend along the length direction parallel to the central slot 10. The leading holes 126 each defines a narrowest portion along the width direction, and a widest portion parallel to the central slot 11.

The left wall 123 defines a flexible locking arm 1231 protruding toward the right wall 124 from an inner surface of the cavity 125 along the length direction. The locking arm 1231 has a first locking block 1232 and a first V-shape locking slot 1233 located between the inner surface and the first locking block 1232. Both of the first locking block 1232 and the locking slot 1233 are spaced outwardly from the receiving space 120 along the width direction.

The retainer 3 is made from insulative material, and includes a body portion 31 received in the cavity 125, a latch projection 32 extending inwardly beyond the first wall 127 from one end of the body portion 31 along the width direction, and a triangle shape operation portion 33 protruding outwardly from the body portion 31 along the width direction. The latch projection 32 directly extends outwardly from an inner surface of the body portion 31. The body portion 31 defines a depression 310 recessed from an inner surface of another end thereof, a second locking block 311 adjacent to the depression 310, and a second locking slot 312 disposed between the second locking block 311 and the latch projection 32 along the length direction. The second locking slot 312 is recessed from the inner surface of the body portion 31. The body portion 31 further defines a pair of upper positioning posts 315 protruding upwardly from an upper surface thereof, and a pair of lower positioning posts 316 protruding downwardly from a bottom surface thereof along the vertical direction. The upper positioning posts 315 are opposited to the lower positioning posts 315 in the vertical direction. Each pair of positioning posts 315, 316 are spaced from each other and aligned to each other along the length direction. The latch projection 32 protrudes through the receiving space 120 along the width direction to be disposed above the second wall 128. The operation portion 33 defines a plurality of ribs 330 at an outer surface thereof for handling.

The retainer 3 is received in the cavity 125 of the holding portion 12. The latch projection 32 extends inwardly into the receiving space 120 to lock in the cutout 203 of the electronic card 200. The pair of upper positioning posts 315 are received in the leading hole 126 of the upper wall 121 to prevent the retainer 3 from rotating relative to the housing 1. The lower positioning posts 316 are received in the leading hole 126 of the bottom wall 122 to prevent the retainer 3 from rotating relative to the housing 1. The upper wall 121 and the bottom wall 122 each defines a pair of guiding slots 1261 corresponding to the positioning posts 315, 316 so as to guide the positioning posts 315, 316 to be inserted into the slider holes 126 respectively. The upper positioning posts 315 or the lower positioning posts 316 define a distance between two outer sides thereof along the length direction. The distance is shorter than a length of leading hole 126. Thus, the positioning posts 315, 316 can move in the leading holes 126 along the length direction. The retainer 3 can not be pulled out of the holding portion 12 by handling.

In an inserting process of the electronic card 200 to the card edge connector 100, firstly, inserting the electronic card 200 downwardly into the central slot 11. The key portions 116 are respectively received in the notches 206 of the electronic card 200 for preventing the electronic card 200 from moving along the length direction. The locking arm 1231 and an outer surface of the electronic card 200 define a gap therebetween. Then, the retainer 3 with the latch projection 32 moves toward the central slot 11 by the operation portion 33 pushed by handling along the length direction. The latch projection 32 defines an outer arc surface 320 for guiding the latch projection 32 to slide on the projection 202 of the electronic card 200. It would bring down a friction between the latch projection 32 and the projection 202 of the electronic card 200. Finally, the latch projection 32 locks into the cutout 203 and abuts downwardly against the projection 202 for stop the electronic card 200 from moving upwardly. The left wall 123 is received in the depression 310 of the retainer 3. The left wall 123 abuts against an inner wall of the depression 310 for preventing the retainer 3 from moving further toward the central slot 11. The first locking block 1232 of the holding portion 12 locks into the second locking slot 312 of the retainer 3 and abuts against the second locking block 311 along the length direction to prevent the retainer 3 from returning to original position to assure the latch projection 32 in close position steadily. The latch projection 32 protrudes through the cutout 203 and beyond another outer surface of the electronic card 200. The latch projection 32 not abuts against the electronic card 200 along the length direction. The electronic card 200 is prevented from moving along the length direction only by key portion 116 of the housing 1.

While the electronic card 300 is being ejected, pushing the operation portion 33 to moving far from the central slot 11 along the length direction. The second locking block 311 abuts against the first locking block 1232 to force the locking arm 1231 to be deflected toward the electronic card 200 until the second locking block 311 is separated from the locking arm 1231. When the latch projection 32 moves out of the cutout 203 of the electronic card 200, the electronic card 200 would be pulled out of the central slot 11 easily by handling.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A card edge connector for use with an electronic card, comprising:

an elongated housing having a pair of opposited side walls, a central slot between the side walls and a holding portion at one end thereof;

a plurality of terminals retained in the housing and protruding into the central slot for mating with the electronic card; and a retainer movably retained in the holding portion, the retainer having a body portion and a latch projection protruding inwardly from the body portion for locking the electronic card;

wherein the holding portion includes a first wall extending outwardly along a length direction, a cavity passing through the first wall along a width direction perpendicular to the length direction, the first wall is aligned with one of the side walls, the body portion of the retainer is received in the cavity;

wherein the first wall has an upper wall, a bottom wall opposited to the upper wall, a left wall, and a right wall connected to each other to form the cavity thereamong, the left wall directly connects with the one of the side walls, the right wall is located at outside of the left wall along the length direction;

wherein the upper wall and the bottom wall each defines a leading hole, the leading hole of the upper wall is opposited to the leading hole of the bottom wall along a vertical direction, the body portion defines a pair of upper positioning posts protruding upwardly into the leading hole of the upper wall, and a pair of lower positioning posts protruding downwardly into the leading hole of the bottom wall, the positioning posts are movable in the leading holes along the length direction so as to prevent the retainer from being separated from the holding portion; and wherein the left wall defines a flexible locking arm protruding toward the right wall from an inner surface of the cavity, a gap formed between the flexible locking arm and an outer surface of the electronic card, the flexible locking arm has a first locking block and a first V-shape locking slot formed therebetween, the body defines a second locking block locking into the first locking slot for preventing the retainer from moving while the retainer being in a close position.

2. The card edge connector as claimed in claim 1, wherein the leading hole is elliptic-shape and defines a narrowest portion, and a widest portion extending parallel to the central slot.

3. The card edge connector as claimed in claim 1, wherein the electronic card has a projection at one side end thereof, and a cutout above the projection, the holding portion has a second wall connected to another side wall, and a receiving space between the first wall and the second wall for receiving the projection of the electronic card, the first wall is higher than the second wall, the latch projection passes through the receiving space along the width direction to be disposed above the second wall.

4. The card edge connector as claimed in claim 3, wherein the latch projection is adapted for locking with the cutout of the electronic card, and defines an arc surface for guiding the latch projection to slide on the projection of the electronic card, the electronic card defines a lower mating edge for being inserted into the central, and a plurality of notches formed in the mating edge, the housing defines a plurality of key portions disposed in the central slot for being received into the notches for preventing the electronic card from moving along the length direction, the latch projection can not prevent the electronic card from moving along the length direction.

5. The card edge connector as claimed in claim 1, wherein the retainer has a triangle shape operation portion protruding outwardly from the body portion for handling, the latch projection extends from an inner surface of one end of the body portion, the body portion defines a depression recessed from the inner surface of another end thereof, the left wall is received in the depression of the retainer and abuts against an inner wall of the depression for preventing the retainer from moving toward the central slot while the retainer is in the close position.

6. A card edge connector for use with an electronic card, comprising:

an insulative housing defining an elongated central slot along a lengthwise direction;

a holding portion unitarily located around one end of the housing, the holding portion defining an upper wall, a bottom wall opposited to the upper wall, a cavity formed therebetween, and two opposite leading slots recessed on the upper and bottom wall and in communication with cavity, the leading slots extending along the lengthwise direction; and a retainer including a body portion received in the cavity, a latch projection protruding outwardly of the cavity for locking with the electronic card; wherein the body portion defines a pair of upper positioning posts protruding upwardly therefrom, and a pair of lower positioning posts protruding downwardly therefrom, the upper and lower positioning posts being movably received in the leading slots respectively for preventing the retainer from rotating relative to the housing; and wherein the holding portion includes a left wall and a right wall respectively located at two opposite sides of the cavity, the left wall defines a flexible locking arm with a locking slot disposed in the cavity, the body portion defines a locking block locked in the locking slot while the retainer at a close position.

7. The card edge connector as claimed in claim 6, wherein the leading slots each is elliptic-shape and defines a narrowest portion, and a widest portion parallel to the central slot, the leading slots pass through the upper wall and bottom wall in a vertical direction perpendicular to the lengthwise direction.

8. The card edge connector as claimed in claim 6, wherein the holding portion includes a first wall and a second wall respectively extending outwardly along the lengthwise direction, and a receiving space formed therebetween for receiving a projection at one side end of the electronic card, the first wall is higher than the second wall, the cavity passes through the first wall along a width direction perpendicular to the lengthwise direction, the latch projection abuts downwardly the projection of the electronic card, and passes through the receiving space along the width direction to be disposed above the second wall.

9. A card edge connector comprising:

an insulative housing defining an elongated center slot along a longitudinal direction so as to separate said housing with two opposite side walls;

two rows of contacts disposed in the housing and located by two sides of the center slot;

a holding portion unitarily formed around one end of the housing in said longitudinal direction, said holding portion including an upstanding wall unitarily extending from one of said two opposite side walls, said upstanding wall defining a through cavity in a transverse direction perpendicular to said longitudinal direction; and a retainer including a body portion and a latch projection commonly assembled inwardly into the holding portion in the transverse direction with the latch projection exposed at a position aligned with the center slot in said longitudinal direction; wherein one of said holding portion and said retainer defines a groove structure extending in said longitudinal direction, and the other defines a post structure engaged within the groove structure in a vertical direction perpendicular to both said longitudinal direction and said transverse direction so as to not only retain said retainer to the holding portion but also allow said retainer to move along said longitudinal direction between opposite locked and open positions regard to the housing; wherein said holding portion defines the groove structure and the retainer defines the post structure, said groove structure includes opposite upper and lower halves to sandwich said retainer therebetween in the vertical direction, the post structure includes opposite upper and lower posts on opposite sides of the retainer in said vertical direction for respectively reception with the corresponding upper and lower halves; and wherein one of the holding portion and the retainer defines a locking block and the other of the holding portion and the retainer defines a locking slot adapted to be coupled to said locking block to restrain movement of the retainer with regard to the housing in said longitudinal direction.

* * * * *